United States Patent [19]

Suzuki et al.

[11] Patent Number: 4,944,619

[45] Date of Patent: Jul. 31, 1990

[54] CONSTRUCTION FOR MOUNTING AN INK RIBBON CASSETTE IN A HEAT TRANSFERABLE LINE PRINTER

[75] Inventors: Kenji Suzuki, Shizuoka, Japan; Dunstan P. Sheldon, Altadena, Calif.

[73] Assignees: Star Seimitsu Kabushiki Kaisha; Mag-Tek Inc., both of Japan

[21] Appl. No.: 204,102

[22] Filed: Jun. 8, 1988

[30] Foreign Application Priority Data

Jun. 8, 1987 [JP] Japan ..... 62-141554

[51] Int. Cl.[5] ..... B41J 33/00

[52] U.S. Cl. ..... 400/224.2; 400/208

[58] Field of Search ..... 400/120, 208, 224.2

[56] References Cited

U.S. PATENT DOCUMENTS

| | | | |
|---|---|---|---|
| 3,400,800 | 9/1968 | McMillan et al. | 400/224.2 |
| 4,511,271 | 4/1985 | Oberto | 400/208 |
| 4,649,437 | 3/1987 | Watanabe | 400/208 |
| 4,673,304 | 6/1987 | Liy et al. | 400/224.2 |
| 4,768,039 | 8/1988 | Akutagawa et al. | 400/208 |
| 4,776,714 | 10/1988 | Sugiura et al. | 400/208 |
| 4,828,412 | 5/1989 | Palmlund | 400/208 |

FOREIGN PATENT DOCUMENTS

| | | | |
|---|---|---|---|
| 16876 | 1/1986 | Japan | 400/224.2 |
| 41070 | 2/1987 | Japan | 400/224.2 |

*Primary Examiner*—Edgar S. Burr
*Assistant Examiner*—Ren Yan
*Attorney, Agent, or Firm*—Bruce L. Adams; Van C. Wilks

[57] ABSTRACT

A heat transferable line printer used with a cassette carrying a heat transferable ink ribbon capable of being printed many times. The ink ribbon cassette comprises a case which is symmetrical to left and right, a pair of spools provided within the case, one spool serving as a winding spool whereas the other serving as a supply spool, both of which carry the ink ribbon, and a cylindrical hub gear supported on opposite ends of each of the spools and projected from a notch provided on the side of the case.

The printer comprises a print unit and a feed unit which are pivotably connected with each other through a shaft, the feed unit including a platen extending parallel to the shaft, the print unit having a thermal head extending along the platen. The print unit comprises a pair of spool shafts selectively fitted into the hub projecting from the side of the ink ribbon cassette, the ink ribbon cassette being inversely mounted on the print unit.

3 Claims, 4 Drawing Sheets

CONSTRUCTION FOR MOUNTING AN INK RIBBON CASSETTE IN A HEAT TRANSFERABLE LINE PRINTER

FIELD OF THE INVENTION

The present invention relates to a thermal printer for heat-transferring an ink from a melting or sublimating type ink ribbon to a plain paper, and more particularly to a construction for detachably mounting an ink ribbon cassette in a line printer having a fixed thermal head extending widthwise of the plain paper.

DESCRIPTION OF THE PRIOR ART

A printer using a heat transferable ink ribbon is well known in U.S. Pat. No. 3,596,055, in which printer, a thermal head is carried on a carriage and moved in a reciprocating manner across the paper along the platen together with the carriage. An ink ribbon is arranged along the passage of the thermal head and transported across the paper in synchronism with the movement of the thermal head. Such a printer is called a serial type. U.S. Pat. No. 3,984, 809 discloses a heat transferable line printer having a fixed thermal head extending widthwise of paper, wherein an ink ribbon is superposed on the paper, passes between the thermal head and the platen along with the paper and is fed in the same direction. The heat transferable line printer is advantageous in that a multicolor print can be rendered easy, and in case of monochrome, a high speed printing can be realized.

The heat transferable ink ribbon is made in the form of a cassette and replaceably mounted on the printer. In the case of the heat transferable line printer, in order to replaceably support the ink ribbon cassette, a body thereof comprises a lower unit and an upper unit which are divisible from each other, one unit being carried on the thermal head while the other unit carrying the platen, both the units being pivotably connected. According to U.S. Pat. No. 4,632,585 issued on Dec. 30, 1986, when the upper unit is pivotally opened relative to the lower unit, a cassette holder appears in that open portion, and therefore the ink ribbon cassette can be inserted from the front of said open portion. This inserting direction for the cassette is generally the same as the transporting direction for the ink ribbon. In Japanese Patent Laid-Open Publication No. 125,685/1985 laid-opened on July 4, 1985, after the upper unit or cover has been opened, the ink ribbon cassette is mounted on the lower unit from the top. In this case, the inserting direction for the cassette is generally the direction perpendicular to the transporting direction for the ink ribbon. In Japanese Patent Laid-Open Publication No. 262,678/1985 laid-opened on Dec. 26, 1985, the ink ribbon cassette is mounted from the lower side on the back side of the upper unit or cover. This method of mounting is just the opposite to that proposed in the aforementioned Japanese Patent Laid-Open Publication No. 125,685/1985. Another method was proposed in Japanese Patent Laid-Open Publication No. 114,876/1986 laid-opened on June 2, 1986. In this method, two cantilever shafts are provided within a lower unit, and an ink ribbon cassette is mounted within the lower unit so that these shafts are in engagement with a center hole of a reel within the ink ribbon cassette.

A melting or sublimating type ink ribbon used in a heat transferable printer has been discarded after single use. However, recently, such ribbons that may be used many times have been developed for use. In a heat transferable line printer used together with a cassette having an ink ribbon capable of being used many times as described above, for example, as disclosed in Japanese Patent Laid-Open Publication No. 212,287/1984 laid-opened on Dec. 1, 1984, when the end of the ink ribbon is detected, a portion between the thermal head and the platen is opened, and the ink ribbon passes therebetween and is automatically wound back. When this winding-back is terminated, printing starts again. Such an automatic winding-back function surely seems to be convenient, but actually the, time required for the winding back is so great that the rewinding period cannot be ignored, and loss of printing resulting from the stoppage of printing during that period is not acceptable. Further, a driving mechanism for relatively isolating the thermal head from the platen becomes complicated.

SUMMARY OF THE INVENTION

It is an object of the present invention to provide a heat transferable line printer which is well suited for use with a cassette carrying a heat transferable ink ribbon capable of being used many times.

It is another object of the present invention to provide a heat transferable line printer in which an ink ribbon cassette is designed symmetrically to left and right so that the cassette may be mounted on a print unit from either side.

According to the present invention, there is provided a heat transferable line printer wherein when an ink ribbon is transported from one spool to the other within a cassette and when the end of the ribbon is reached, the cassette can be inverted and mounted on the print unit, without winding back the ink ribbon, to start re-using.

DESCRIPTION OF THE PREFERRED EMBODIMENTS

Figure 1:
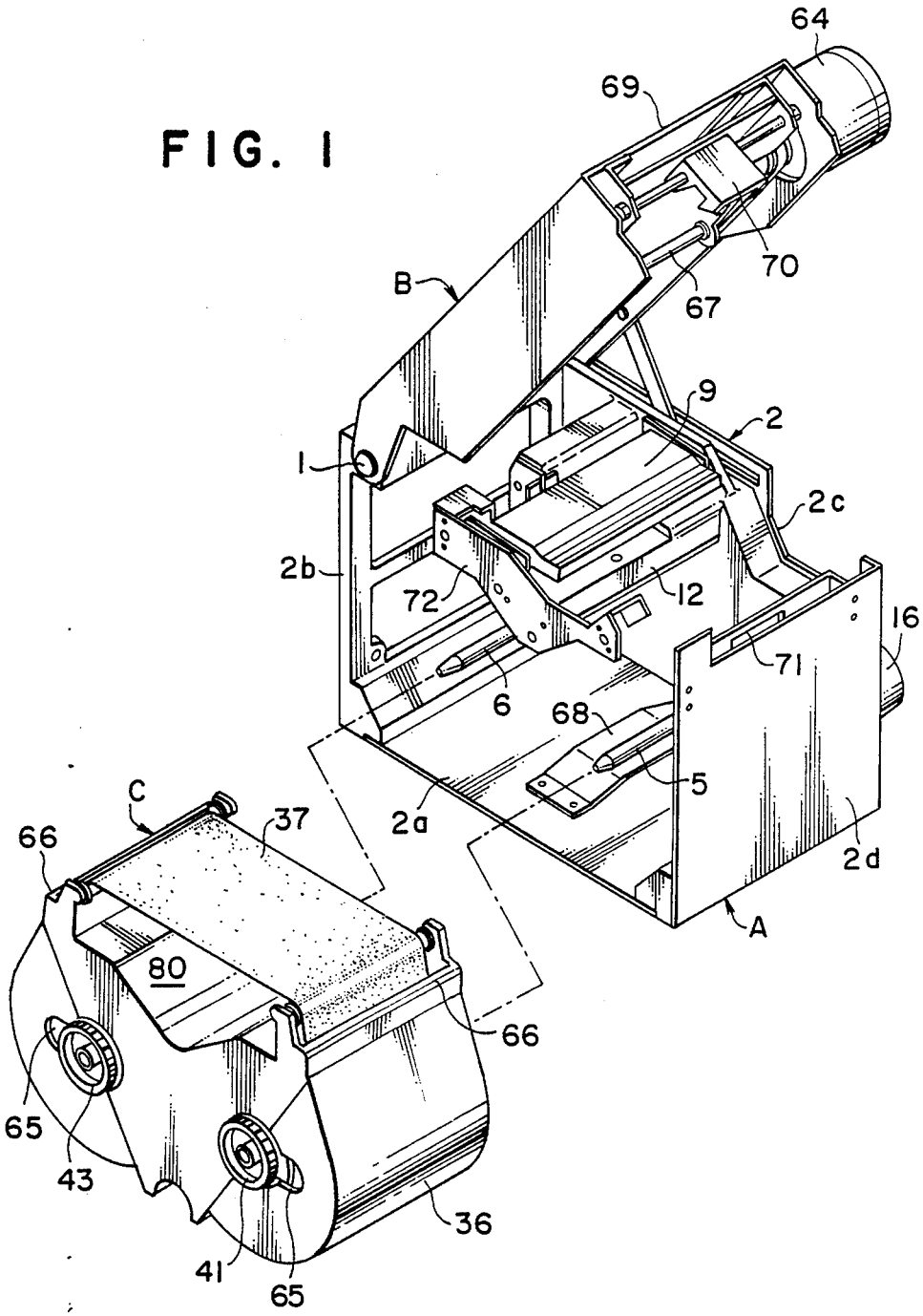
FIG. 1 is a perspective view illustrating the mode of a replacement of an ink ribbon cassette in a heat transferable line printer according to the present invention.
Figure 3:
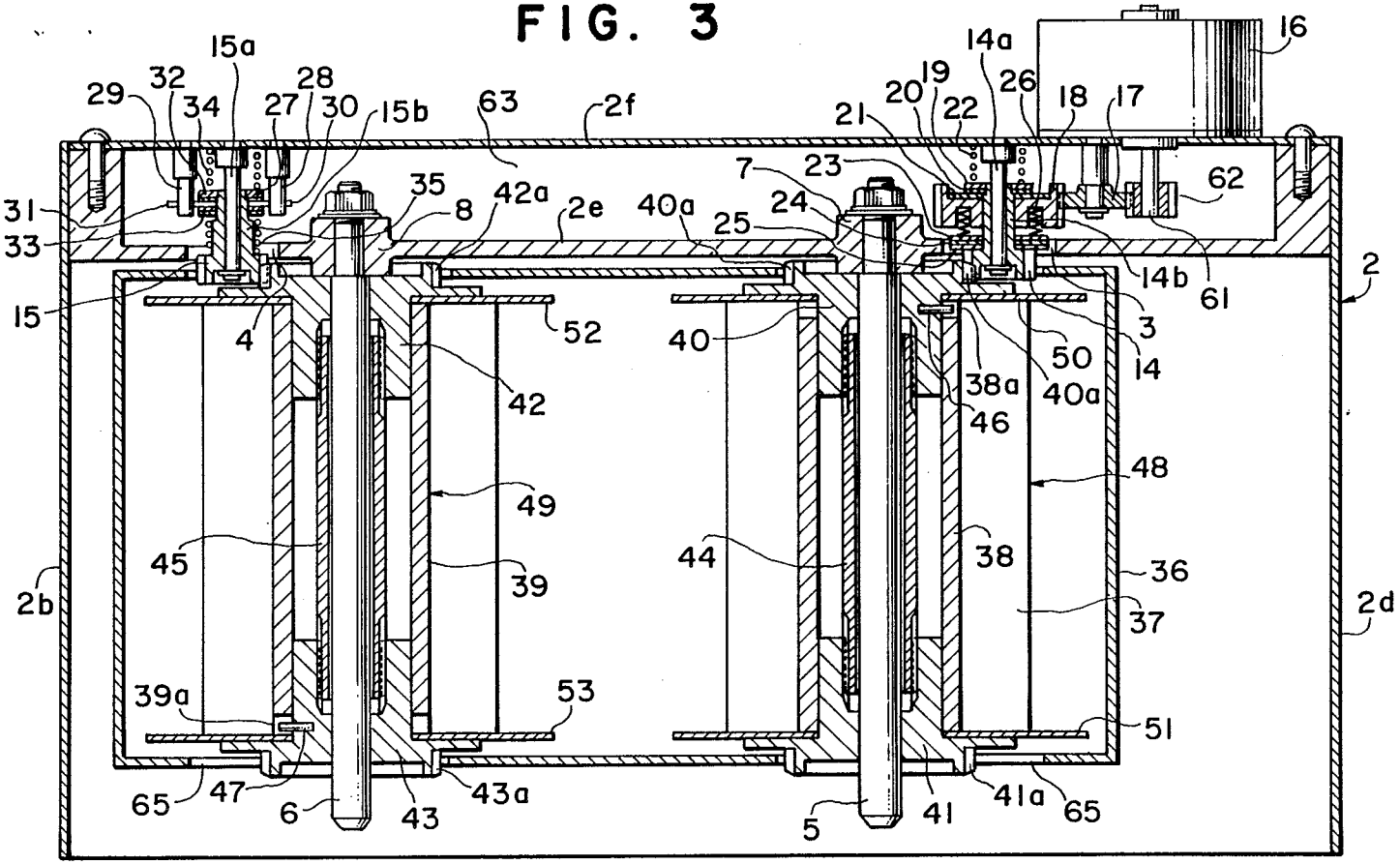
FIG. 3 is a sectional view taken on line 3—3 of FIG. 2.

Referring now to FIG. 1, the heat transferable line printer according to the present invention comprises a print unit A having a fixed thermal print head 9 and a feed unit B connected for pivotal movement through the print unit A on a shaft 1, the print unit A replaceably receiving a heat transferable ink ribbon cassette C. The print unit A has a housing 2 including a bottom **2*a* and three sides 2*b*, 2*c* and 2*d*. Referring to FIG. 3, the side 2*c* is in the form of a double-wall construction including an upright support plate 2*e* and a cover 2*f*, and a space 63 is formed therebetween. The upright support plate 2*e* of the side 2*c* is formed of a rigid material, for example, aluminum diecast, and supports a support arm 12 extending laterally therefrom. It is noted that the support arm 12 can be formed integral with the upright support plate 2*e*. A bracket 72 (FIG. 1) is mounted on the support arm 12, and a shaft 11 for pivotably supporting a head holder 10 is secured between the bracket 72 and the upright support plate 2e. The head holder 10 holds a line type thermal thermal head 9, which is biased by means of a spring 13 mounted in a hole 12a of the support arm 12**.

Figure 2:
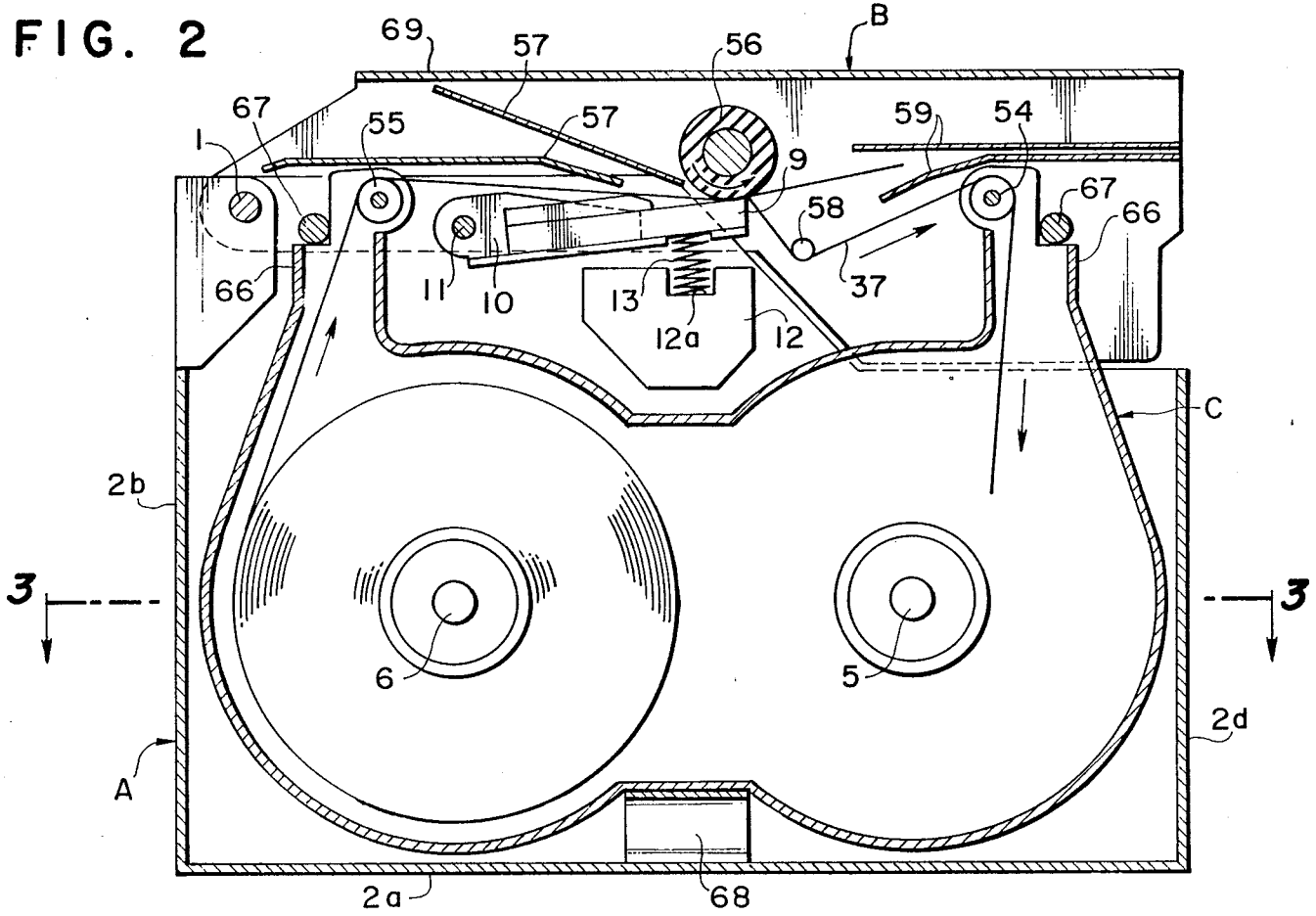
FIG. 2 is a sectional view of the heat transferable line printer shown in FIG. 1.

Turning back to FIGS. 1 and 2, the feed unit B has a cover 69 having a U-shape in section which also serves as a cover for the housing 2, the cover 69 having a platen 56 rotatably supported thereon. The platen 56 is operatively connected to an electric motor 64 mounted externally of the cover 69 and is rotated by the motor 64. The feed unit B is pivotably connected to the print unit A through the shaft 1 and can be opened and closed about the shaft 1. FIG. 1 shows the state wherein the feed unit B is opened whereas FIG. 2 illustrates the state wherein the unit is closed, in which closed state, the platen 56 comes into resilient contact with the thermal head 9 against a drag of the spring 13. In this case, a latch 70 provided on the feed unit B engages an aperture 71 formed in the housing side 2d of the print unit A to retain the resilient contact between the platen 56 and the thermal head 9. The cover 69 includes a feed guide plate 57 and an ejection guide plate 59, the guide plates 57 and 59 defining a passage for paper passing between the platen 56 and the thermal head 9.

Referring to FIG. 3, the print unit A comprises a winding spool shaft 5 and a supply spool shaft 6 comprising two cantilever rods firmly secured to bosses 7 and 8, respectively, of the upright support plate 2e, to support an ink ribbon cassette C having a pair of spools 48 and 49 in engagement with the shafts 5 and 6. The ink ribbon cassette C includes the pair of spools 48 and 49 within a case 36, and a heat transferable ink ribbon 37 is extended between the spools 48 and 49. The spools 4B and 49 each comprise cylindrical cores 38 and 39, flanges 50, 51, 52 and 53 provided on the opposite ends thereof, a pair of hubs 40 and 41, and 42 and 43 inserted into the opposite ends of the cores 38 and 39, and pipes 44 and 45 for interconnecting the pair of hubs 40 and 41, and 42 and 43. In this case, gears 40a, 41a, 42a and 43a are formed around the hubs 40, 41, 42 and 43, respectively. In both sides of the case 36 are formed notches 65 including holes with which are engaged the pair of hubs 40 and 41 of the first spool 5 and the pair of hubs 42 and 43 of the second spool 6, respectively. The hubs 40, 41, 42 and 43 each loosely engage one of the notches 65 and are projected slightly outwardly. This ink ribbon cassette C is designed symmetrically with respect to the left and right ends thereof so that the cassette C may be mounted on the print unit A from either side thereof. Thus, the cassette C may be mounted in the lower print unit A in either a frontward position, wherein the front of the casing lies adjacent the front side of the print unit A, or a backward position, wherein the back of the casing lies adjacent the front side of the print unit A.

Figure 4:
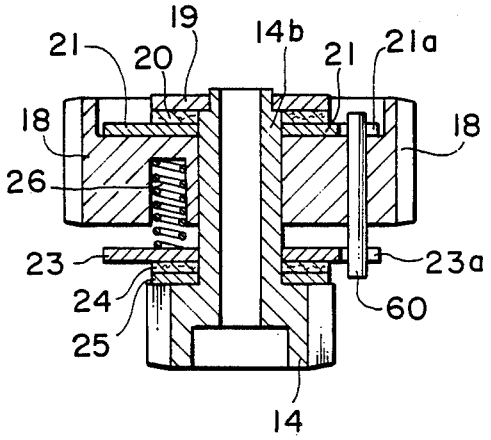
FIG. 4 is a sectional view of a friction clutch shown in FIG. 3.

Referring again to FIG. 3, the upright support plate 2e is formed with a notch 3 adjacent to the boss 7 supporting the winding spool shaft 5, and a geared system including a friction clutch (FIG. 4) is provided within the double-wall space 63 in association with the notch 3. This geared system operatively connects, when the ink ribbon cassette C is mounted on the print unit A, the motor 16 mounted on the housing 2 with a hub gear 40a of the first spool 48 of the ink ribbon cassette C. A gear 62 is secured to a shaft 61 of the motor 16, the gear 62 being meshed with a slip gear 18 through an idler 17. Referring to FIG. 4, the slip gear 18 is fitted in and around a sleeve 14b integrally extending from a drive gear 14 and movable with respect to the sleeve 14b. The slip gear 18 and drive gear 14 are connected through a friction clutch which will be described later. On the axial opposite ends of the slip gear 18 are arranged a first and second driving-side disks 21 and 23 formed of a wear-resistant material, the first driving-side disk 21 being opposed through a felt sheet 20 to a first driven-side disk 19 secured to the end of the sleeve 14b, while the other second driving-side disk 23 is opposed through a felt sheet 24 to a second drivenside disk 25 secured to the side of the drive gear 14. The first and second driving-side disks 21 and 23 have notches 21a and 23a, respectively, and a pin 60 secured to the slip gear 18 comes into engagement with the notches 21a and 23a whereby they are operatively connected. A plurality of springs 26 are arranged between the side of the slip gear 18 and the second driving-side disk 23, and the first and second driving-side disks 21 and 23 are brought into frictional engagement with the first and second drivenside disks 19 and 25 opposed to each other by means of the springs 26. Referring to FIG. 3, the drive gear 14 is rotatably and axially movably supported on a support shaft 14a secured to the cover 2f of the housing 2 along with a friction clutch including the slip gear 18. In this case, a spring 22 is arranged between the cover 2f and the slip gear 18, and in a normal state, the drive gear 14 is biased thereby so as to assume a position at the end of the support shaft 14a. When the ink ribbon cassette C is mounted on the print unit A, the hub gear 40a provided on the first spool 48 of the cassette C is meshed with the drive gear 14 provided on the side of the print unit A and rotated with the drive gear 14 as the latter is driven by the motor 16 to move the ink ribbon 37. When the motor 16 rotates, the gear 62 drives the slip gear 18 through the idler 17. In this case, if the drive gear 14 undergoes a normal load, the slip gear 18 transmits a power to the drive gear 14 through a friction clutch means but if that load is excessively high, the friction clutch means absorbs the power. If the ink ribbon cassette C is mounted along the axial direction of the spool shafts 5 and 6 and when contact between the hub gear 40a of the cassette C and the drive gear 14 on the side of the print unit A occurs, the drive gear 14 is temporarily moved back in an axial direction and thereafter realizes a proper engagement.

The upright support plate 2e is formed with a notch 4 adjacent to the boss 8 supporting the spool shaft 6, and an antislipping means or a back-tension applying means is provided in association with the notch. The back-tension applying device comprises a back-tension gear 15 rotatably supported on the support shaft 15a secured to the cover 2f of the housing 2, a fixed disk 27 in engagement with a pair of pins 28 and 29 secured to the cover 2f, a pair of rotational disks 32 and 33 in frictional engagement with the sides, respectively, of the fixed disk 27, the rotational disks being supported axially movably but unrotatably with respect to the back-tension gear 15, and springs 34 and 35 for resiliently biasing the rotational disks 32 and 33 against the fixed disk 27. The back-tension gear 15 is projected slightly outwardly from the notch 4 formed in the upright support plate 2a, and when the ink ribbon cassette C is mounted on the print unit A, the back-tension gear 15 comes to mesh with the hub gear 42a of the second spool 49 of the cassette C to frictionally restrain the the rotation of the second spool 49. Further, since the back-tension gear 15 is movable in an axial direction, the contact between the back-tension gear 15 and the hub gear 42a of the second spool 49 upon the mounting of the cassette C is, like in the case of the drive gear 14 is overcome.

Turning again to FIG. 1, the case 36 of the ink ribbon cassette C is provided with shoulders 66 in a portion adjacent to a pair of guide rollers 54 and 55 (FIG. 2) for the ink ribbon 37. The cassette C is mounted, in the state wherein the feed unit B is opened, by fitting the hubs 40 and 42 provided on the ends of the spools 48 and 49 into the spool shafts 5 and 6 of the print unit A, and thereafter, when the feed unit B is closed, two rods 67 provided on the unit B come into engagement with both shoulders 66 of the cassette C to press the cassette C toward a plate spring 68 mounted on the bottom 2*a* of the print unit A thereby retaining a proper position. The proper position of the ink ribbon cassette C with respect to the axial direction of the spool shafts 5 and 6 is realized by a flange formed on the end of a rod 67 provided on the feed unit B, and the flange may engage the end of the shoulder 66 of the cassette C.

In mounting the ink ribbon cassette C on the print unit A, the feed unit B is opened from the print unit A, whereby the platen 56 is moved away from the thermal print head 9. and therefore the thermal print head 9 is moved into a space 80 between the case 36 of the cassette C and the ink ribbon 37. Thereafter, when the feed unit B is closed, the ink ribbon 37 is put between the thermal head 9 and the platen 56. After the feed unit B has been closed, a sheet of paper can be inserted into a path defined by the feed guide 57, and the end of the paper is fed between the platen 56 and the thermal head 9, then the printing is ready to start. It is noted that a paper feeder for feeding the paper to the path can be provided. When printing on the paper has been terminated in a well known manner, the paper is fed to an outlet via the ejection guide 59, and ink ribbon 37 moves to the winding spool 48 passing around the guide roller 54. For easily moving the ink ribbon 37 away from the paper, a roller 58 for guiding the ink ribbon 37 in a direction of moving away from the paper is provided on the side of the feed unit B.

At the stage when the ink ribbon 37 on the supply spool 49 has been exhausted, printing is stopped, the feed unit B is opened, the ink ribbon cassette C is taken out of the print unit A, and the cassette C is inverted and then again mounted on the print unit A. In this manner, printing onto the ink ribbon 37 many times can be extremely easily accomplished by the inversion of the ink ribbon cassette C.

What is claimed is:

1. A line printer comprising:

upper and lower units pivotably connected with each other through a pivot shaft, the upper unit having therein a platen extending parallel with the pivot shaft, the lower unit having therein a thermal print head extending under and along the platen of the upper unit and a pair of spool shafts fixed at one end thereof to the inside of a back side portion of the lower unit and extending below the thermal print head and parallel to the pivot shaft;

a symmetrical ink ribbon cassette removably mounted in the lower unit and carrying an ink ribbon passing between the platen and the thermal print head, the ink ribbon cassette comprising a casing having front and back sides and having a symmetrical shape to enable mounting of the casing in the lower unit in either a frontward position in which the casing front side lies adjacent the front side of the lower unit or a backward position in which the casing back side lies adjacent the front side of the lower unit, a pair of guide rollers extending parallel with each other on an upper side of the casing for guiding the ink ribbon therebetween; first and second spools disposed within the casing and detachably coaxially receiving therein the respective spool shafts of the lower unit for reversibly transporting the ink ribbon therebetween, and a cylindrical hub gear fixedly disposed on and around each of the opposite ends of the respective spools and projecting outwardly through a corresponding opening formed in one of the front and back sides of the casing;

power transmitting means carried by the lower unit and having a driving gear selectively engageable with one of the two cylindrical hub gears of the first and second spools, depending on whether the casing is mounted in the frontward or backward position, for driving the selected spool to wind the ink ribbon through engagement between the driving gear and the cylindrical hub gear;

back-tension applying means carried by the lower unit and having a back-tension gear selectively engageable with one of the two cylindrical hub gears other than the ones engageable with the driving gear of the power transmitting means, depending on whether the casing is mounted in the frontward or backward position, for preventing slipping rotation of the spool being used for feeding the ink ribbon to the other spool;

locking means for releasably locking the ink ribbon cassette in an operating position thereof in cooperation with the pair of spool shafts within the upper and lower units, the locking means comprising a pair of shoulders formed outside the respective guide rollers on the upper side of the casing, a pair of rods fixedly disposed within the upper unit so as to extend along and engage with the respective shoulders, a plate spring disposed on the bottom of the lower unit for urging the casing against the rods to thereby engage the shoulders with the rods, the rods being immovably positioned relative to the lower unit, and a flange formed on an end of each rod so that the flange engages with one of the opposite ends of the shoulders to thereby hold the ink ribbon cassette in position with respect to the axial directions of the spool shafts;

first gear-adjusting means coacting with the power transmitting means for resiliently absorbing impact between the teeth of the cylindrical hub gear and the driving gear, which impact is caused when the ink ribbon cassette is loaded into the lower unit with these gear teeth being mutually aligned, and for subsequently adjusting these gears to suitably mesh with each other; and second gear-adjusting means coating with the back-tension applying means for resiliently absorbing impact between the teeth of the cylindrical hub gear and the back-tension gear, which impact is caused when the ink ribbon cassette is loaded into the lower unit with these gear teeth being mutually aligned, and for subsequently adjusting these gears to suitably mesh with each other;

whereby the ink ribbon cassette is releasably simply locked in the same operating position regardless of whether the ink ribbon cassette is mounted in the lower unit in the frontward or backward position.

2. A line printer according to claim 1; wherein the first gear-adjusting means comprises a support shaft secured at one end thereof to the inside of the back side portion of the lower unit and extending parallel to the spool shafts and rotatably and axially movably supporting thereon the driving gear of the power transmitting means, and a spring interposed between the driving gear and the inside of the back side portion of the lower unit for biasing the driving gear to the other end of the support shaft to thereby effect engagement of the driving gear with one of the hub gears of the ink ribbon cassette.

3. A line printer according to claim 1; wherein the second gear-adjusting means comprises a support shaft secured at one end thereof to the inside of the back side portion of the lower unit and extending parallel to the spool shafts and rotatably and axially movably supporting thereon the back-tension gear of the back-tension applying means, a ring disc disposed around an intermediate portion of the support shaft and fixed to the back side portion of the lower unit through fixing means, and a spring interposed between the back-tension gear and the rink disc for biasing the back-tension gear to the other end of the support shaft to thereby effect engagement of the back-tension gear engageable with one of the hub gears of the ink ribbon cassette.

* * * * *